US006038984A

United States Patent [19]

Freitag

[11] Patent Number: 6,038,984

[45] Date of Patent: Mar. 21, 2000

[54] TOOL TRAY

[76] Inventor: Rodney T. Freitag, 1004 Bygland Rd., East Grand Forks, Minn. 58204

[21] Appl. No.: 09/145,001

[22] Filed: Sep. 1, 1998

[51] Int. Cl.[7] ..... A47B 23/00

[52] U.S. Cl. ..... 108/44

[58] Field of Search ..... 108/44, 45, 47, 108/42; 224/42.26, 42.29, 42.12, 42.13; 297/100.18, 135

[56] References Cited

U.S. PATENT DOCUMENTS

| | | | |
|---|---|---|---|
| 2,692,174 | 10/1954 | Whitehead | 108/43 X |
| 2,797,973 | 7/1957 | Culpepper | 297/135 X |
| 3,269,555 | 8/1966 | Henderson | 108/47 X |
| 4,341,304 | 7/1982 | Diller | 108/44 X |
| 4,403,806 | 9/1983 | Stephen | 108/44 X |
| 5,598,786 | 2/1997 | Patterson | 108/43 |

*Primary Examiner*—Jose V. Chen
*Attorney, Agent, or Firm*—Robert E. Kleve

[57] ABSTRACT

A tool tray for detachably mounting to the top of a vehicle tire having a rectangular bottom panel with opposing lateral sides and opposing front and rear sides extending upward from the bottom panel. A pair of resilient straps are mounted to the tray and extend downward from the lateral opposing sides of the bottom panel and bowing outward for detachably engaging the lateral outward bowed sides of the tire tray in complementary relation. A pair of adjustable plates are mounted to the front and rear of the tray and are adjustable downward below the bottom panel for engagement with the longitudinal circumference tread of the tire to accommodate the longitudinal curvature of the tire to prevent the tray from tilting to the front or to the rear on the tire.

3 Claims, 1 Drawing Sheet

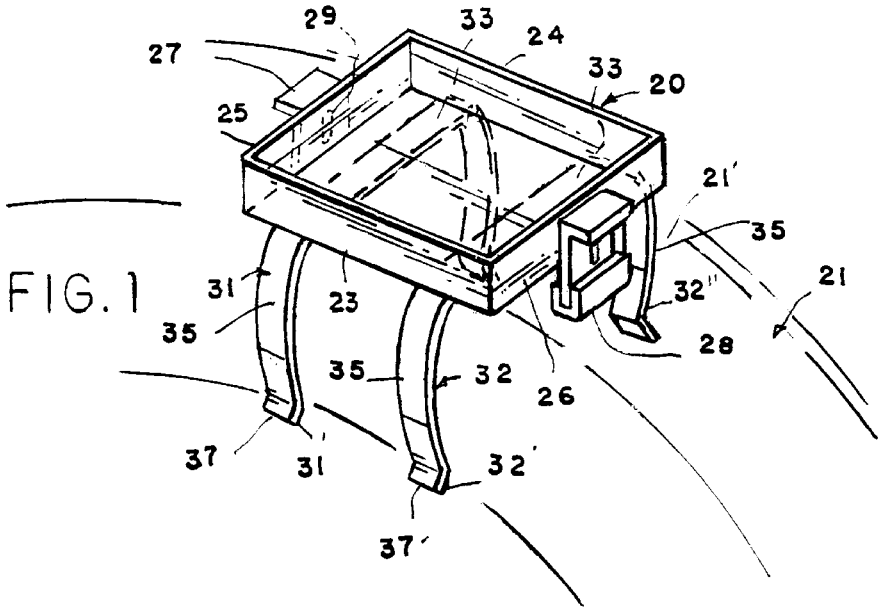
FIG. 1
FIG. 2
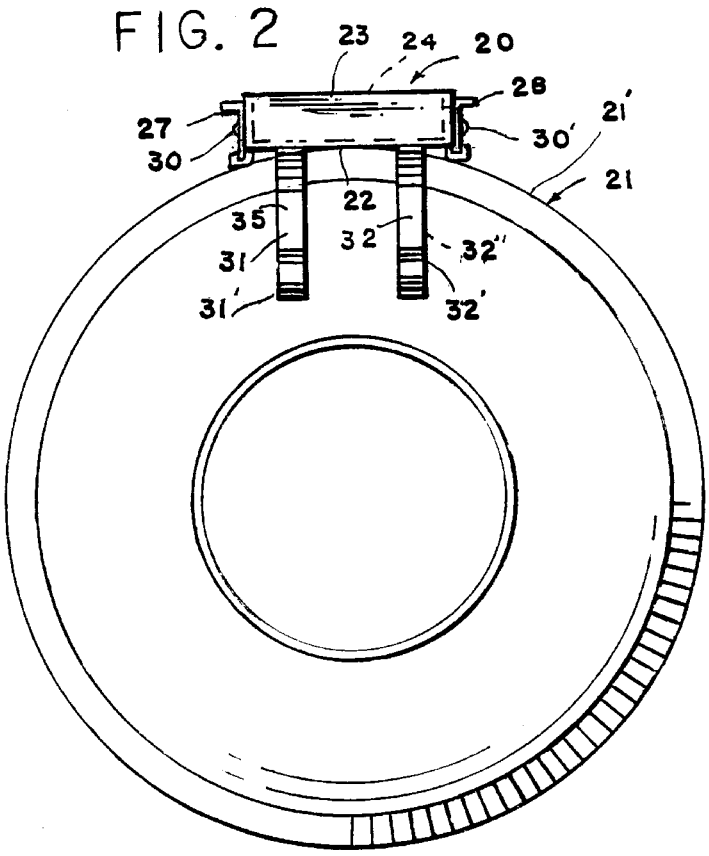
FIG. 3
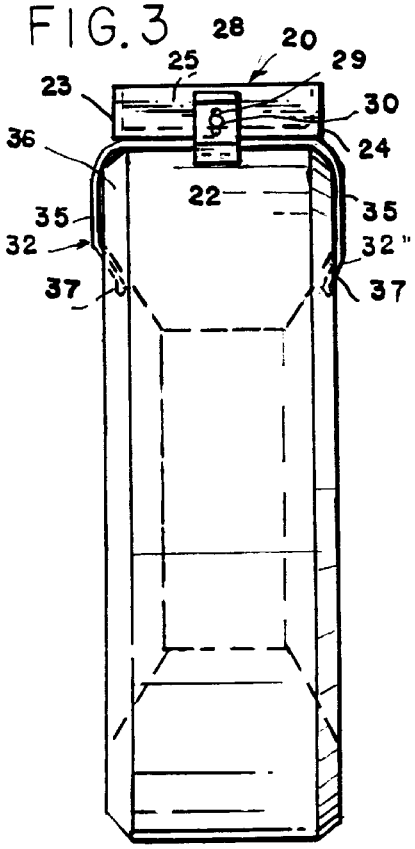

TOOL TRAY

This invention relates to tool trays. More particularly, the invention relates to tool trays having tire attachment means for detachably mounting the tray to a tire.

It is an object of the invention to provide a novel tool tray which may be detachably mounted to the top of the a upstanding tire.

It is a further object of the invention to provide a novel tool tray for detachably mounting to the top of a front tire of a a truck having a cab and front fender which is movable upward away from the front tires for repairs whereby the tray may be mounted to a front tire while the front fenders are moved away from the front tires to enable an operator to have his tools readily accessable to him on a tray nearby when repairing the front engine of the truck wherein the engine is nearby between the front tires of the truck.

It is another object of the invention to provide a novel tool tray leaving resilient legs for detachably encircling and mounting to a tire.

Further objects and advantages of the invention will become apparent as the description proceeds and when taken in conjunction with the accompanying drawing wherein:

BRIEF DESCRIPTION OF THE DRAWING

FIG. 1 is a perspective view of the tool tray invention shown detachably mounted to the top of a truck tire.

FIG. 2 is a side view.

FIG. 3 is a front elevational view of the tool tray invention shown detachably mounted to the top of a truck tire.

BRIEF DESCRIPTION OF PREFERRED EMBODIMENT

Briefly stated, the invention comprises a novel tool tray having a bottom with front and rear panels and side panels to form an enclosure with an open top for receiving a storing tools. A pair of resilient metal straps are mounted to the bottom panel of the tray and their four ends extend downward for encircling and engaging the opposite sides of the top of a tire, when the tray is resting on the top of the tire. A pair of vertically adjustable panels are mounted to the front and rear panels of the tray and are vertically adjustable to enable the panels to engage the curved top tread portion of the tire curving away from the front and the rear of the tray when the tray is resting on the top of the tire to stabilize the tray on the tire and prevent tilting in a front or rear direction on the tire.

Referring more particularly to the drawing in FIGS. 1–3, inclusive, the tool tray invention 20 is shown mounted to a truck tire 21 along the top 21' of the truck tire. The tray 20 has a bottom 22 and front and rear panels 23 and 24 and side panels 25 and 26 each fixed to the bottom panel 22 along their edges. A pair of adjustment plates 27 and 28 are adjustably mounted to the front and rear panels 23 and 24. The adjustment plates each have a vertical slot 29 and a pair of screws 30 and 30' are threaded into the front and rear panels 23 and 24 through the slots with the heads 31 of the screws engaging the adjustment panels on each side of the slots to hold the panels in their adjusted position on the front and rear panels of the tray 20. A pair of resilient metal straps 31 and 32 are mounted at their intermediate portions 33 to the bottom panel 22 of the tray with their four our ends 31', 32', 31", 32" extend downward downward from the tray forming four leg portions. Each leg portion has an outward bowed portion 35 which bows outward to encircle the outer sides 36 of the truck tire 21 and each leg portion is biased inward with leg portion 32' biased toward leg portion 31' and leg portion 31" biased toward leg portion 32" one another sufficiently to firmly engage against the sides of the tire to hold the tray firmly to the top of the tire. The bottom ends 37 of the strap or leg portions each have outwardly bent ends to enable the tray straps to easily slide outward onto oppose sides of the tire and downward along the outer side of the tire when attaching the tray to the tire.

Operation

The tool tray 20 is operated as follows:

The tool tray invention 20 will be used customarily for repairing the engine adjacent front portion of a convention truck of the type of truck which has the front cab and front fenders which pivot upward and backward away from the front tires and front engine and associates front components of the truck, with the tray 20 mounted to one of the front tires of the truck as the top of the truck after the fenders and cab have been swung away so as to be nearby the engine and front components of the truck when an operator is working on the engine or front components of the truck to repair them. The four straps portions 31, 32, 31' and 32' will hold the tray detachably and firmly on the top of one of the front tires of the truck and the adjustment panels will be adjusted upward or downward on the front and rear panels of the tray if necessary to place the bottom edges of the adjustment panels firmly against the front and rear tread portions 35 and 35' of the tire to prevent the tray from tilting toward the front or rear. The amount of adjustment will depend upon the particular size and diameter of the particular truck tires mounted to the front of the truck being repaired.

The four strap portions 31, 32, 31', 32' may also serve as legs to support the tray on the ground beside the operator, by the four legs supporting the four corners of the tray so that the tray can be used to store tools while resting on the ground beside the operator.

Also the four leg portions may be made separately with each having an adjustable upper portion extending along the bottom panel 22 of the tray and bolted to the bottom of the tray with an elongate slot in the upper portions to receive the bolts for bolting the straps to the bottom panel and which upper portions will be parallel to the bottom panel and with the slots enabling the strap portions 31 and 32 to be slide toward or away from one another and strap portions 31' and 32' to be slid toward or away from one another to adjust the leg portions so that they may firmly grasp the sides of tires of different widths.

Thus, it will be seen that a novel tool tray has been provided for mounting to the front tire of a truck to be nearby the engine of the truck so as to be also nearby and readily accessable to the operator when repairing the engine of the truck.

It will be obvious that various changes and departures may be made to the invention without departing from the spirit and scope thereof, and accordingly, it is not intended that the invention be limited to that specifically described in the specification, or as illustrated in the drawing, but only as set forth in the appended claims wherein:

What is claimed is:

1. A tool tray having a bottom panel and front and rear panels extending upward from front and rear of the bottom panel and opposing lateral side panels with an open top, a pair of resilient straps mounted on opposite portions of the bottom panel with their upper ends and with their lower ends extending downward from the tray in opposing lateral relation, said straps having lateral outward bowed intermediate portions for engaging a vehicle tire having outward bowed side portions when the tray is positioned on the tops of the tire to secure the tray to the tops of the vehicle tire, said tray having front and rear adjustment panels mounted to the front and rear panels of the tray and adjustable upward and downward at the front and rear of the tray relative to the bottom of the tray to firmly engage the tire along its tread to the front and rear of the tray to prevent the tray when mounted to the tire from tilting toward the front or toward the rear.

2. A tool tray for mounting to a vehicle tire in which the tire has a circular longitudinal extending tread portion with lateral opposing sides, said tray having a bottom panel with lateral opposing sides extending upward from the lateral opposing edges of the bottom means, resilient strap means extending downward from the lateral opposing sides of the bottom panel of the tray for engaging the lateral sides of the tire, said tray having means along its front and rear extending downward from the bottom panel adjacent the front and rear of the tray for engaging the tire longitudinally along its circular tread at the front and rear of the tray to prevent the tray from tilting to either the front or to the rear relative to the tire when mounted on the tire.

3. A tool tray for mounting to a vehicle tire in which the tire has a circular longitudinal extending tread portion with outward bowed side portions, said tray having a bottom panel with front and rear sides extending upward from the bottom panel adjacent its front and rear, and lateral opposing side panels extending upward from the lateral opposing sides of the bottom panel resilient strap means extending downward from the lateral opposing sides of the bottom panel of the tray and bowing outward to detachably engage in complementary relation the lateral outward bowed portion of the tire to secure the tray to the tire said tray having spaced means along its front and rear, respectively, to engage the tire longitudinally to prevent front or rear tilting of the tray.

* * * * *